US008376174B2

(12) United States Patent
Nerswick et al.

(10) Patent No.: US 8,376,174 B2
(45) Date of Patent: Feb. 19, 2013

(54) SPILL PROOF SNACK BOWL

(76) Inventors: Thomas A. Nerswick, Fort Mitchell, KY (US); David Hamann, Cincinnati, OH (US)

( * ) Notice: Subject to any disclaimer, the term of this patent is extended or adjusted under 35 U.S.C. 154(b) by 1386 days.

(21) Appl. No.: 11/051,695

(22) Filed: Dec. 24, 2004

(65) Prior Publication Data

US 2005/0144708 A1 Jul. 7, 2005

Related U.S. Application Data

(60) Provisional application No. 60/533,991, filed on Jan. 3, 2004, provisional application No. 60/553,316, filed on Mar. 15, 2004.

(51) Int. Cl.
*B65D 51/04* (2006.01)
*B65D 43/16* (2006.01)

(52) U.S. Cl. ..... 220/254.5; 220/825; 220/829

(58) Field of Classification Search ..... 220/254.3, 220/254.5, 229, 825, 829; 131/235.1, 237, 131/242

See application file for complete search history.

(56) References Cited

U.S. PATENT DOCUMENTS 1,472,476 A * 10/1923 Kendzierski ..... 43/60
1,983,139 A * 12/1934 Lovell ..... 220/256.1
2,800,244 A * 7/1957 Witt ..... 220/254.5
3,749,274 A * 7/1973 Mele et al. ..... 220/825
3,871,550 A * 3/1975 Chiappe ..... 220/825
3,982,658 A * 9/1976 Bozek et al. ..... 220/268
4,328,904 A * 5/1982 Iverson ..... 220/229
4,776,478 A * 10/1988 Miller et al. ..... 220/254.5
4,884,717 A * 12/1989 Bussard et al. ..... 220/229
5,156,291 A * 10/1992 Mielke ..... 220/254.5
5,706,972 A * 1/1998 Sousa ..... 220/714
6,843,387 B2 * 1/2005 Karaki et al. ..... 220/229
2003/0062366 A1 * 4/2003 Moss ..... 220/229

* cited by examiner

*Primary Examiner* — Anthony Stashick
*Assistant Examiner* — James N Smalley

(57) ABSTRACT

The invention is a spill proof snack bowl or container with a box section which may have a beveled bottom. The box section may be square, rectangular, round, oval or spherical. The bowl has a continuous wall to create a depth and an open top and a removable lid. The removable lid has a secondary opening which opening is closed by a secondary opening piece. The secondary opening piece is attached to the removable lid with a regular or living hinge. The secondary opening piece closes the secondary opening with a flat spring. The distance between the front wall and the secondary opening piece edge, and the distance between side perpendicular width of the secondary opening piece and side walls are between about ⅛ and ½ inch. Optionally the secondary opening has an elastomeric seal. The secondary opening piece has rounded edges, and the secondary opening has rounded ridges. The invention likewise comprises a process of providing pea or Cheerio™ sized snacks to children, teenagers or adults including the steps of removing the lid on a snack bowl, placing the snack in the snack bowl; replacing the lid on the snack bowl. The child is provided with the snack bowl.

8 Claims, 25 Drawing Sheets

SPILL PROOF SNACK BOWL

CROSS-REFERENCE TO RELATED APPLICATIONS

This application claims the benefit of priority under 35 U.S.C. §119 from U.S. Provisional Applications Ser. No. 60/533,991, filed Jan. 3, 2004, and Ser. No. 60/553,316, filed Mar. 15, 2004, the entire contents of which are herein incorporated by reference.

FIELD OF INVENTION

The invention is concerned with bowls or containers for snack pieces which are peanut sized, Cheerios™ sized, pea sized or other various sized snack pieces. Likewise, the present invention is concerned with spill proof snack bowls that release or aliquot the snack in smaller amounts to lengthen the time required to finish the snack.

BACKGROUND OF INVENTION

Snacks are important to small children. Younger children need to be fed more often than older children or adults. Likewise, small children require smaller amounts of food with each feeding. Thus parents of these children often times provide small dried snacks such as raisins, Cheerios™ or other cereals. In addition to needing smaller snacks as such small children need something to distract them especially when traveling. Time spent occupied with small dried food snacks is time that the child does not disturb the parent. Children are well known for their abilities to spill food and drinks. For these reasons it is desirable to have a spill proof bowl to lessen the spilling of food by children. Likewise, it is desirable to have snacks dispensed in smaller amounts or aliquots, not only for children but also for dieting teenagers or adults.

Young children are often unable to open food containers that have removable lids. Normally such lids are designed for adult use. Young children find it difficult if not impossible to remove ordinary lids from food containers. Children likewise have difficulties reattaching the lids of such containers. During both the process of removing or replacing lids on food or drink containers the contents often are spilled by children.

The specific advantage of the present invention is that the short distance from door opening to front and side walls prevents fingers from getting caught between door and walls; and the hand from getting trapped in a large open area. Likewise in certain embodiments the short distance from lower end of door opened 90 degrees relative to top surface of bowl bottom prevents the hand from getting trapped in a large open area. Turned down edge(s) on the secondary door prevents fingers from being caught. Certain embodiments have turned up ridges around secondary openings to prevent catching fingers.

While the present invention is most useful for dry snack pieces, the proper modification of the container portion will allow that modified container to be used as spill resistant drink containers. Other embodiments of the container such as placing the lid on a vertical side will allow the container to be used for larger dry pieces.

Various types of modified lids which have secondary openings are known to the art. For example U.S. Pat. No. 4,679,700 disclosed a self closing top for a container. U.S. Pat. No. 4,328,904 teaches a modified lid for a container which lid allows a hand into the container to pickup one or more pieces of material that is in the bottom of the container. A similar type container is taught by U.S. Pat. No. 3,116,927 to blindly present game pieces for the game of that patent.

SUMMARY OF INVENTION

The invention is a spill proof snack bowl or container with a box section which may have a beveled bottom. The bowl has a continuous wall to create a depth and an open top and a removable lid. The removable lid has a secondary opening which opening is closed by a secondary opening piece. The secondary opening piece is attached to the removable lid with a regular or living hinge. The secondary opening piece closes the secondary opening with a biasing means such as a flat spring. The secondary opening piece has a hinged length and a perpendicular width. The perpendicular width has a ratio with the box depth such that when a friction fitting lid is affixed to the box section and further when the secondary opening piece is opened, the opening angle may exceed 90 degrees. Likewise, the secondary opening piece has a curved down front edge and curved down side edges. The box section may be square, rectangular, round, oval or spherical. The secondary opening optionally has curved side ridges and a curved front ridge. The secondary opening piece optionally has a turned down periphery.

The distances between the front wall and the secondary opening piece edge, and the distance between side perpendicular width of the secondary opening piece and side walls are between about ⅛ and ¾ inch. Optionally the secondary opening has an elastomeric seal.

The invention likewise comprises a process of providing pea or Cheerio™ sized snacks to children, teenagers or adults including the steps of removing the lid on a snack bowl, placing the snack in the snack bowl; replacing the lid on the snack bowl. The child is provided with the snack bowl. The snack bowl comprises a box section which has a generally flat bottom, a continuous wall to create a depth and an open top and a lid with a secondary opening. A secondary opening piece is provided to close that secondary opening. The secondary opening piece is attached with a hinge to a removable lid. The secondary opening piece has a hinged length and a perpendicular width which closes the secondary opening by a biasing means such as a leaf (flat) spring.

The ratio of the perpendicular width with the box depth is such that when the lid is affixed to the box section and when the secondary opening piece is opened the opening angle may exceed 90 degrees, or in an alternative embodiment may be between about 40 degrees and 75 degrees. The child will reach his fingers into the snack bowl and retrieve a small portion of the snack pieces. The secondary opening piece as it is opened will push by rotational thrust excess snack from an accessible volume to a relatively inaccessible volume of the container bowl. The child will then transfer the assessable snack pieces to his mouth. The container or box section is generally square or rectangular, but may be generally round, oval, spherical, or bowl shaped and has a friction fitting lid or a threaded rim lid.

The invention discloses second type of secondary opening piece for a spill proof snack bowl which has the secondary opening piece, living hinge, and biasing means combined in a single unit. This opening piece may have curved down edges.

Likewise, the present invention is a removable lid for a container for a food snack with a secondary opening and a secondary opening piece with a width and edges and a length and a hinge. Secondary opening piece has rounded turned down edges, and a fiction fitting lid or a threaded rim lid.

A spill proof snack bowl which has a box section that is generally round, oval, spherical, bowl shaped, truncated puck shaped, box shaped, tumbler shaped square, or rectangular.

DETAILED DESCRIPTION OF FIGURES

Figure 1:
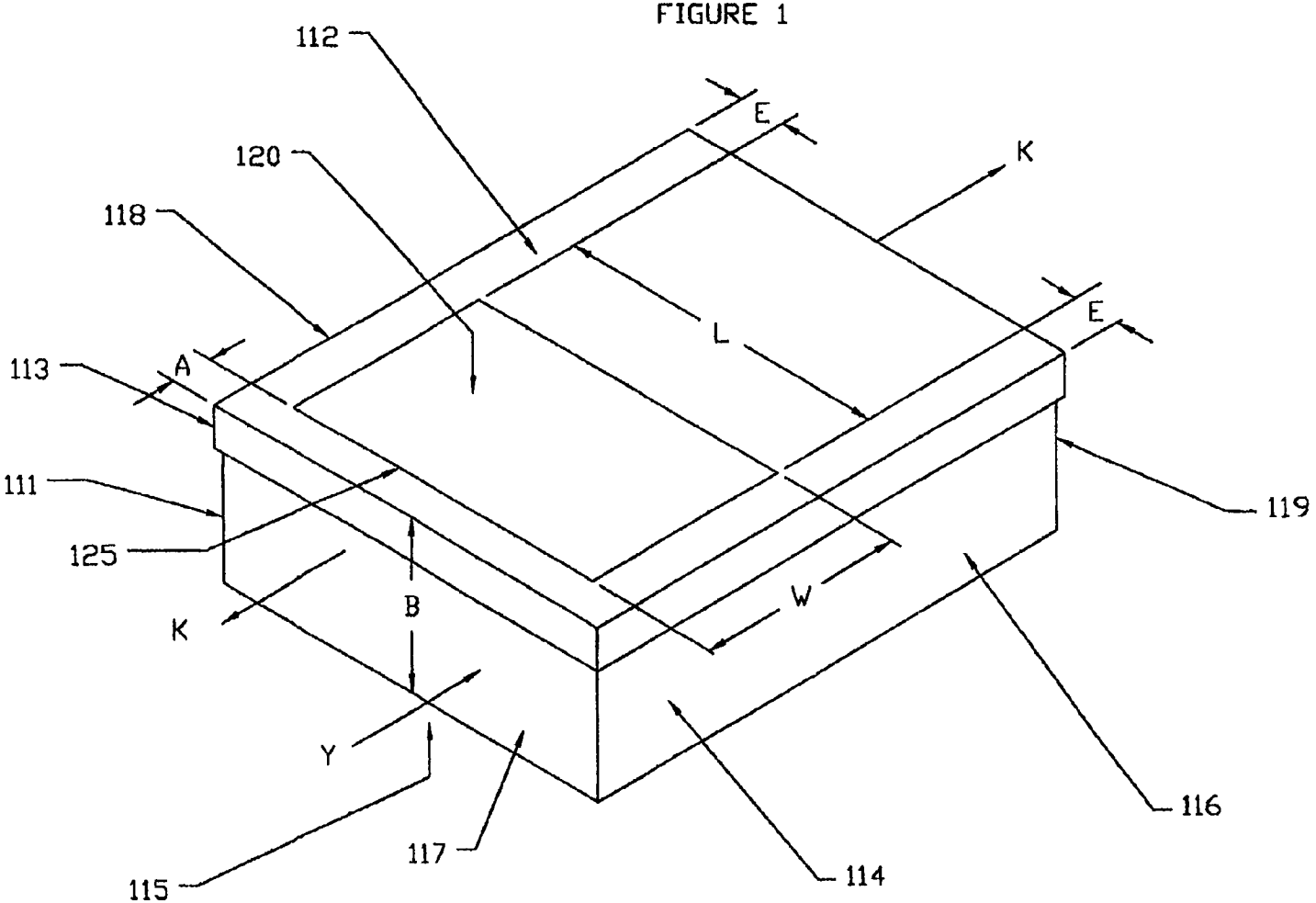
FIG. 1 shows a perspective of a spill proof snack bowl.

FIG. 1 shows a perspective of a spill proof snack bowl 111. Snack bowl 111 has a friction fitting lid 112 with a lip ridge 113. Friction fitting lid 112 is affixed to primary opening on generally square or rectangular box section 114. Box section 114 has a generally flat bottom 115 and four sides 116, 117, 118, and 119 to create a depth (arrow B). Friction fitting lid 112 has a secondary opening piece 120. Friction fitting is one means of attaching a removable lid. Secondary opening piece 120 has hinge length L and a perpendicular width W. Length A is a first distance between the front wall 117 and the secondary opening piece 120 leading edge 125. Lengths E are second distances between the side edges of secondary opening piece 120 and the side walls 116 and 118. Because of less coordination of small children the lengths A and E should be between about ⅛ and ¾ inch so that the snack can be more easily removed. An important aspect of the present invention is the placement and size of the secondary opening. The short distance from the door opening and sides prevent fingers from being caught between the secondary opening and the side 117 and the hand from being caught in the space Y. The embodiments in which the width of the secondary opening is nearly the same as the depth prevents the hand from entering and being caught in the container. Likewise, the rounded turned down edges of that secondary opening piece 120 prevents the little fingers from being caught as the food is withdrawn from the bowl.

Figure 2:
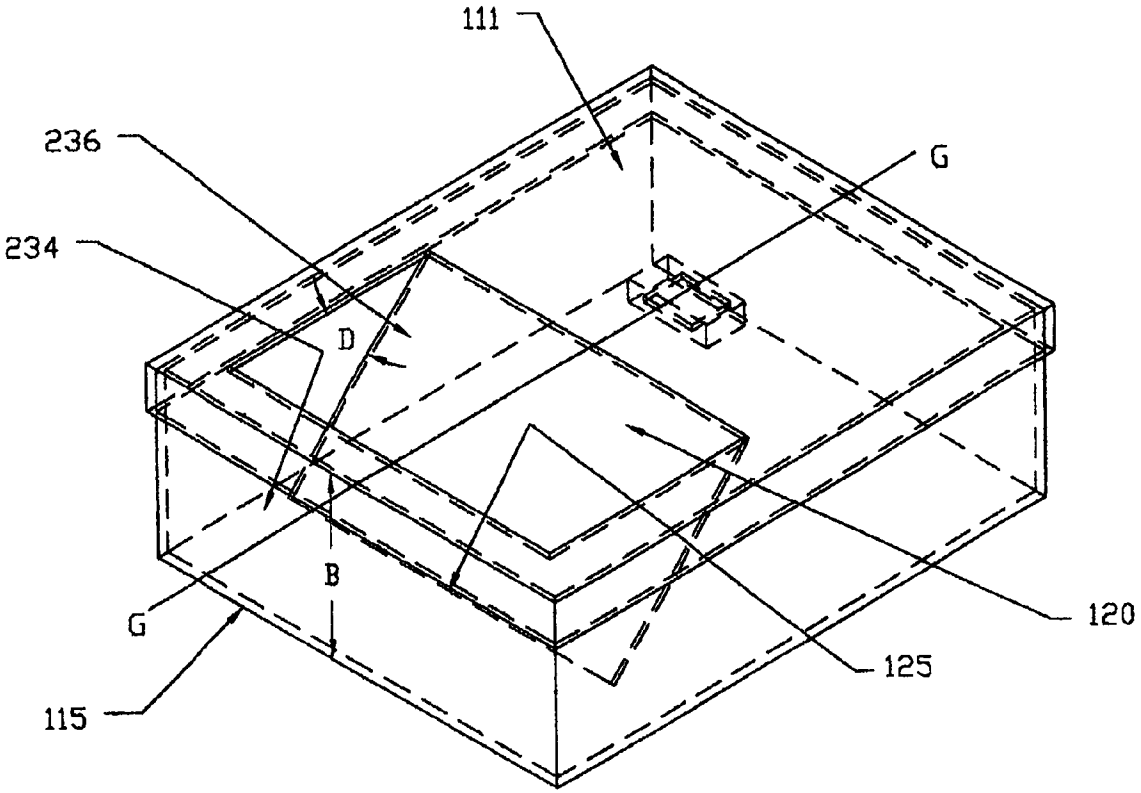
FIG. 2 shows a second perspective of spill proof snack bowl.

FIG. 2 shows a perspective of spill proof snack bowl 111 with depressed secondary opening piece 120. Secondary opening piece 120 is depressed until leading edge 125 reached the upper side 234 of generally flat bottom 115. The depression of secondary opening piece 120 produces an angle D and access hole 236. Angle D is the angle defined by the friction fitting lid 112 and secondary opening piece 120 as front edge 125 touches upper side 234 of generally flat bottom 115. Opening angle D is between about 35 degrees and 75 degrees.

Figure 3:
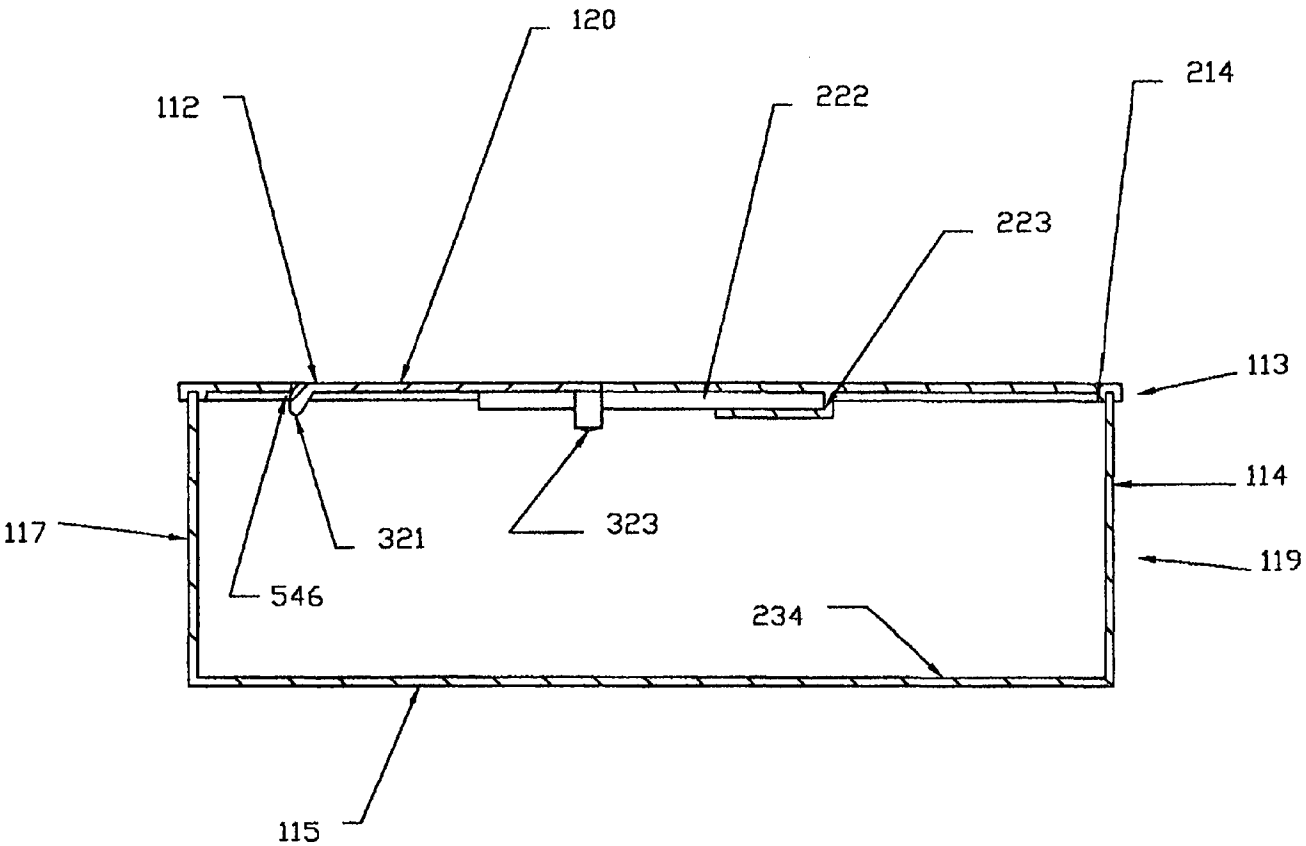
FIG. 3 shows cut K-K shown in FIG. 1.

FIG. 3 shows cut K-K shown on FIG. 1. Sides 117 and 119 of box section 114 are shown in section. Generally flat bottom 115 with upper side 234 is shown in section. Friction fitting lid 112 with a secondary opening piece 120 is affixed to generally square or rectangular box section 114 with outer lip ridge 113 and inner lip ridge 214. Leaf (flat)) spring 222 affixed in slot 223 provides a resilient means to keep secondary opening piece 120 closed. The leaf spring 222 and slot 223 need not be separate. The spring 222 can be affixed to the lid 112 by means such as pressed in, molded in, riveted in and other means know to the art. Note secondary opening piece 120 has a curved front edge 321. This curved front edge 321 prevents small hands from being caught as secondary opening piece 120 comes up to front rim 546. Hinge 323 allows secondary opening piece 120 to be deflected downward to produce opening angle D.

Figure 4:
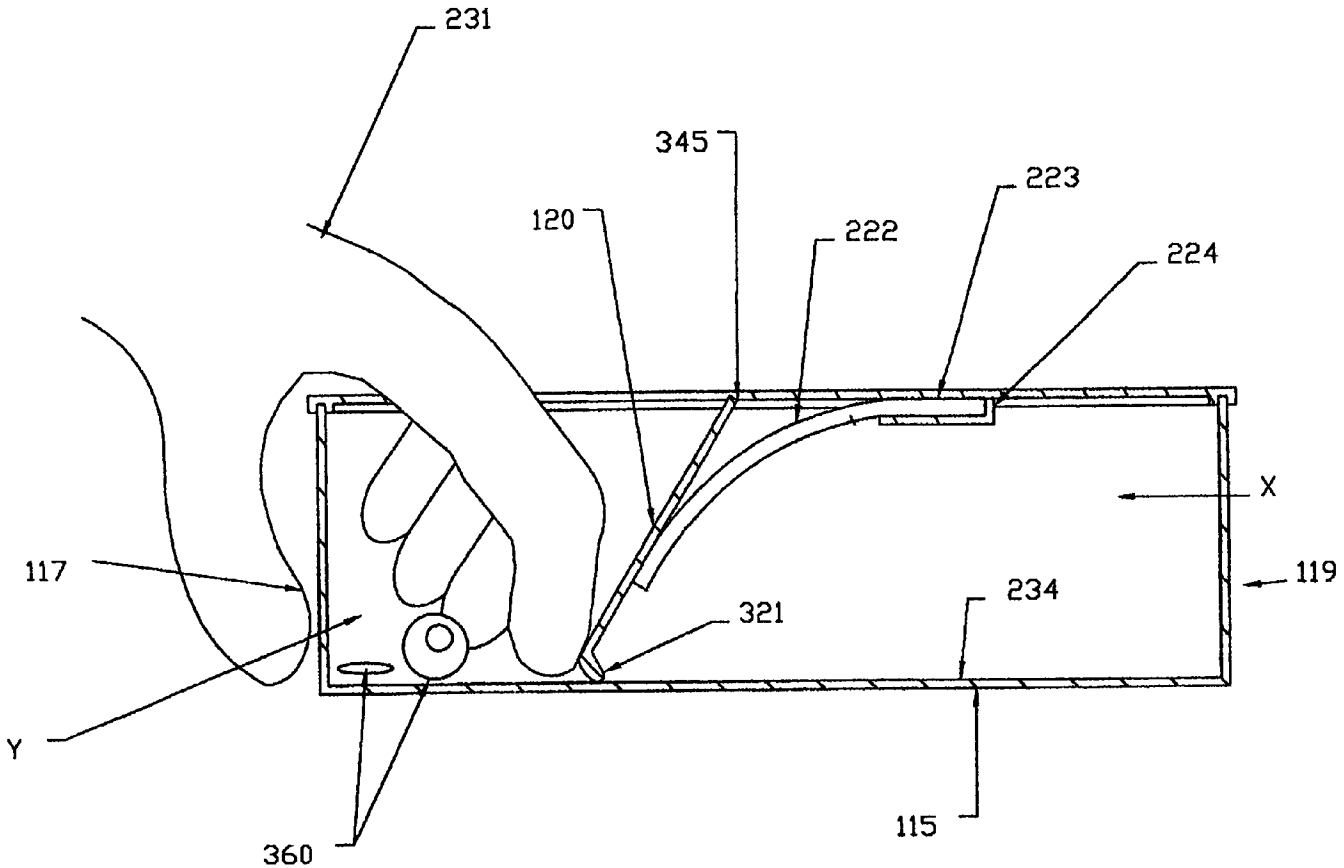
FIG. 4 shows slice G-G shown in FIG. 2.
Figure 5:
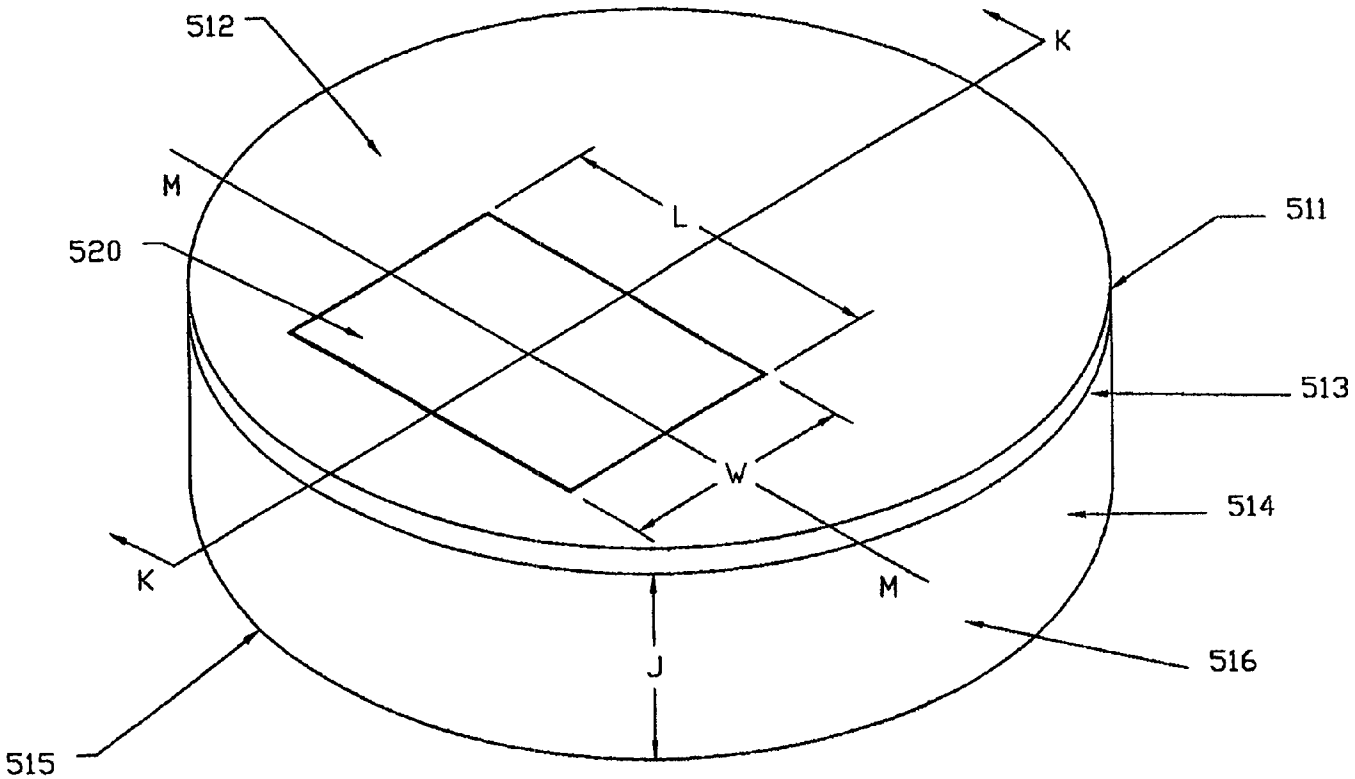
FIG. 5 shows a perspective of a second embodiment of spill proof snack bowl.

FIG. 4 shows cut G-G shown on FIG. 2. Sides 117 and 119 of box section 114 are shown in section. Generally flat bottom 115 with upper side 234 is shown in section. Friction fitting lid 112 with a secondary opening piece 120 is affixed to generally square or rectangular box section 114 with outer lip ridge 113 and inner lip ridge 214. A flat spring 222 affixed in slot 223 provides a resilient means to keep secondary opening piece 120 closed. Note secondary opening piece 120 has a curved front edge 321. Living hinge 345 allows secondary opening piece 120 to be deflected downward to produce opening angle D. A small portion is provided by the rotational thrust of secondary opening piece 120 pushing excess snack from accessible volume Y to a relatively inaccessible volume X. Operator fingers 231 are reaching into accessible volume Y for workpiece snack 360 shown as torus shaped Cheerios™ 360. FIG. 5 shows a perspective of a second embodiment of spill proof snack bowl 511. Snack bowl 511 has a friction fitting lid 512 with a lip ridge 513. Friction fitting lid 512 is affixed to generally round or oval box section 514. Box section 514 has a generally flat bottom 515 and a continuous wall 516 to create a depth (arrow J). Friction fitting lid 512 has a secondary opening piece 520. Secondary opening piece 520 has hinge length L and perpendicular width W.

Figure 6:
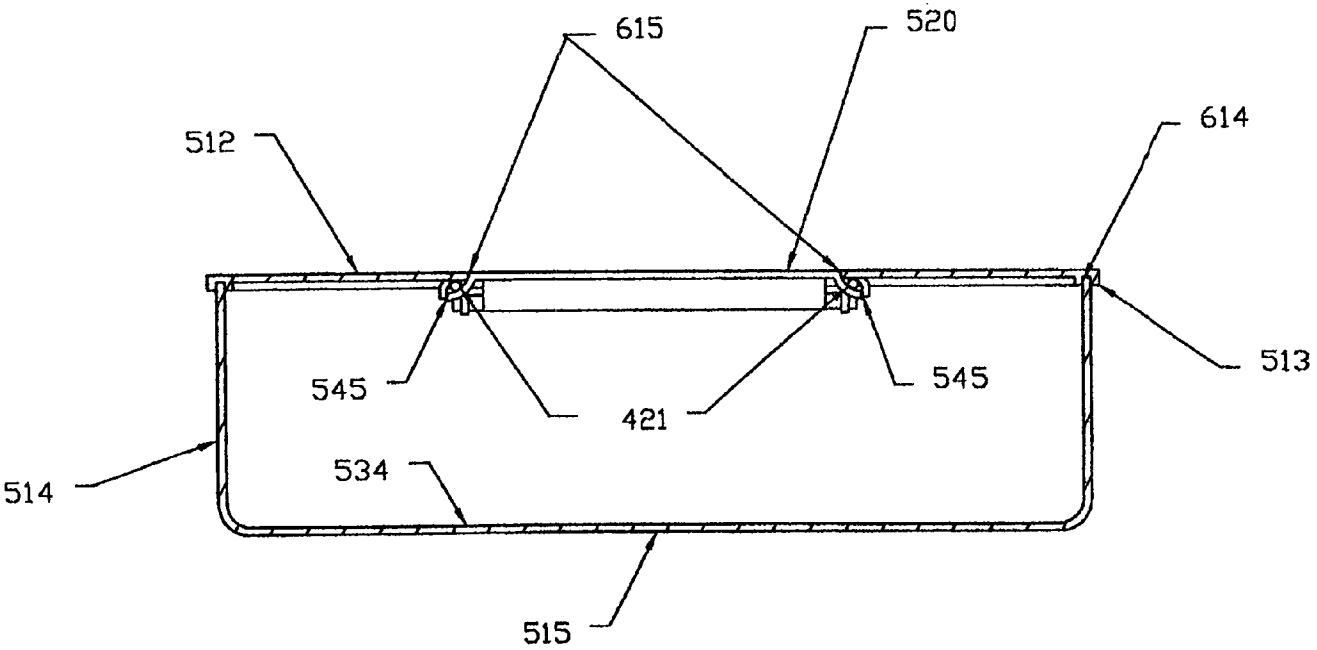
FIG. 6 illustrates cut M-M as shown in FIG. 5.

FIG. 6 illustrates cut M-M as on shown on FIG. 5. Generally flat bottom 515 with upper side 534 is shown in section.

Friction fitting lid 512 with a secondary opening piece 520 is affixed with outer lip ridge 513 and inner lip ridge 614 to generally round or oval box section 514. Note secondary opening piece 520 has curved side edges 421. An elastomeric seal 615 is placed on curved side edges 421 of secondary opening piece 520. Optionally in rim 545 of secondary opening piece 520. Rim 545 is complementary with curved side edge 421 to create a waterproof seal.

Figure 7:
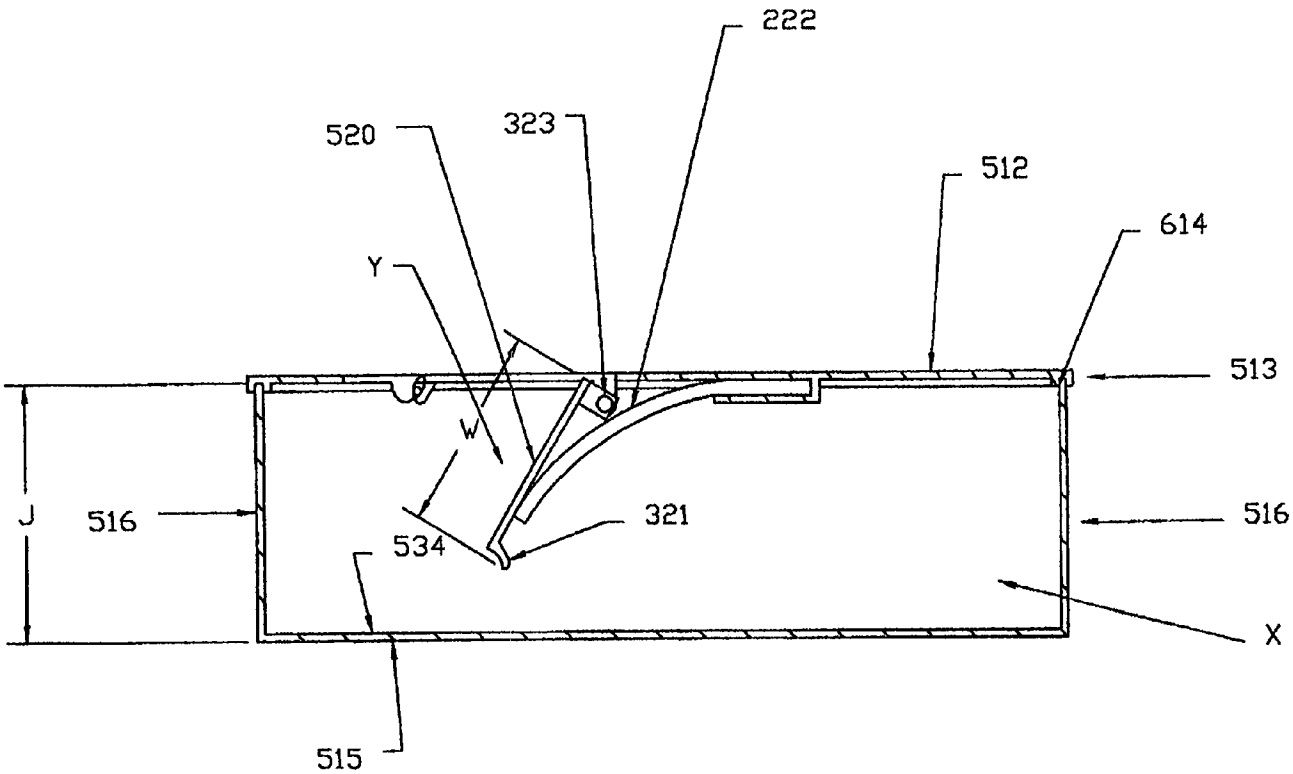
FIG. 7 shows slice K-K illustrated in FIG. 5.

FIG. 7 shows slice K-K illustrated on FIG. 5. Continuous wall 516 of box section 514 is shown in section. Generally flat bottom 515 with upper side 534 is shown in section. Hinge 323 allows secondary opening piece 520 to be deflected downward. A flat spring 222 affixed in slot 223 provides a resilient means to urge secondary opening piece 520 to close. Note secondary opening piece 520 has a curved front edge 321. Hinge 323 allows secondary opening piece 520 to be deflected downward. Note width W of secondary opening piece 520 is less than height J of continuous wall 516 so that secondary opening piece 520 can freely open to angles greater than 90 degrees. Small portions are provided in accessible volume Y by the downward thrust of secondary opening piece 520 pushing excess snack to a relatively inaccessible volume X.

Figure 8:
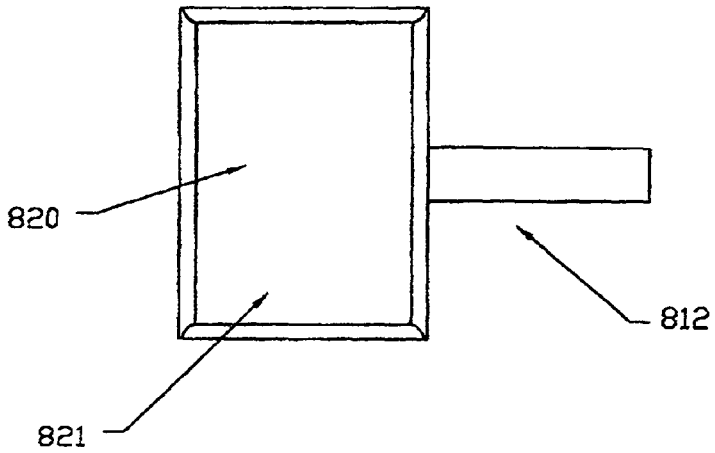
FIGS. 8, 9, and 10 show a secondary opening piece for a spill proof snack bowl.

FIG. 8 shows a secondary opening piece 820 for a spill proof snack bowl. This secondary opening piece 820 has a flat door 821 to close a secondary opening. The secondary opening piece 820 for a spill proof snack bowl has as single molded unit, a flat door 821 combined with a unitarian hinge/flat spring 812 to close a secondary opening.

Figure 9:
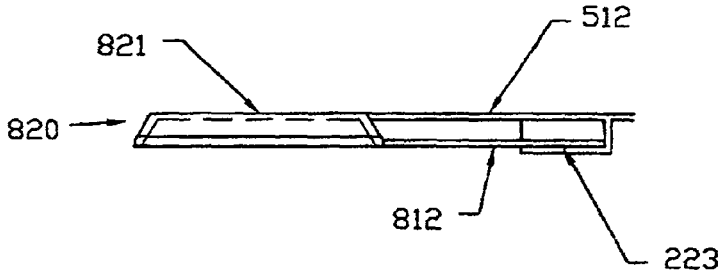

FIG. 9 shows secondary opening piece 820 for a spill proof snack bowl. Unitarian hinge and flat spring 812 attach to friction fitting lid 512 by means of slot 223. Unitarian hinge/flat spring 812 provide rotational means and biasing means for flat door 821.

Figure 10:
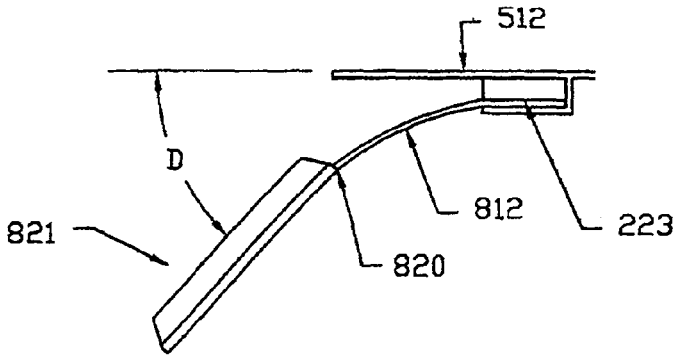

FIG. 10 shows secondary opening piece 820 for a spill proof snack bowl. Flat door 821 combined with unitarian hinge and flat spring 812, attached to slot 223, are deflected downward to produce angle D.

Figure 11:
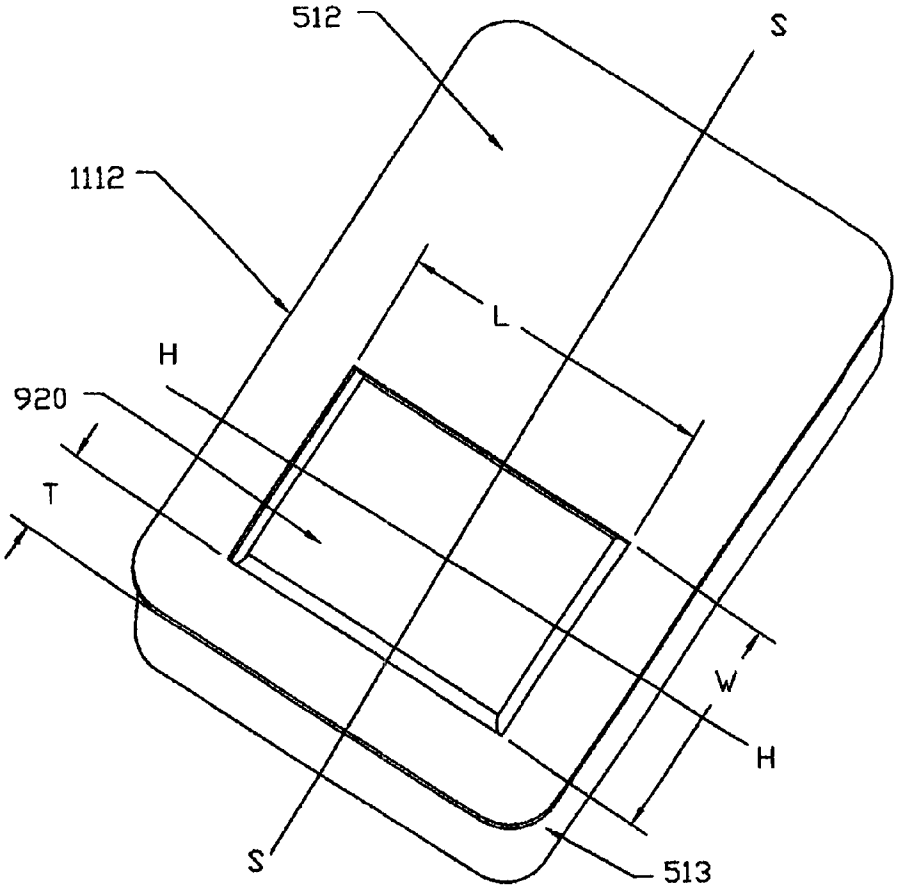
FIG. 11 shows an alternative friction fitting lid for the container for snacks.

FIG. 11 shows an alternative friction fitting lid 1112 for the container for snacks. Secondary opening piece 920 has a length L and a width W. Outer lip ridge 513 will affix lid 1112 to a container for snacks. The distance T between the forward lip of secondary opening piece 920 and the inner lip ridge should be between about ⅛ and ¾ inch.

Figure 12:
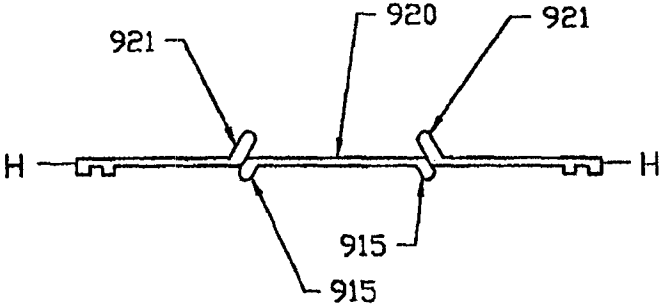
FIG. 12 shows the cut H-H of FIG. 11.

FIG. 12 shows the cut H-H of FIG. 11. Cut H-H through alternative friction fitting lid 1112 with secondary opening piece 920 shows rounded, turned up side rims 921 of secondary opening 236. Turned up rim 921 is complemented by the turned down edge 915 of secondary opening piece 920. Turned up side rim 921 and turned down side edges 915 prevent small fingers and hands from being caught in secondary opening.

Figure 13:
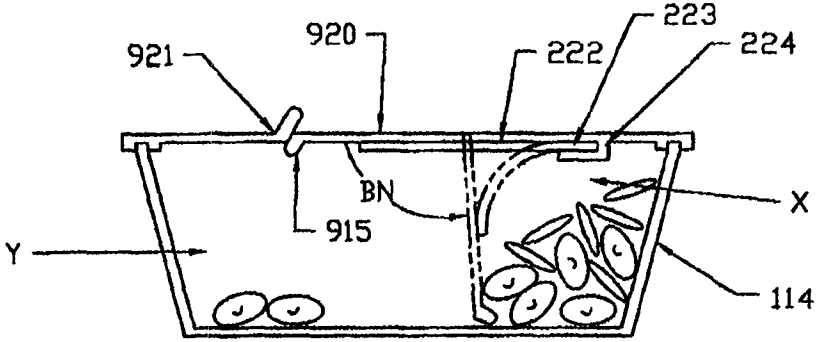
FIG. 13 shows the cut S-S of FIG. 11 with a section of container for the food snack.

FIG. 13 shows the cut S-S of FIG. 11 with a section of container 114 for the food snack. Secondary opening piece 920 has a curved down front edge 915. This is complemented by turned up rim 921 of secondary opening 236. Arrow BN shows that opening pieces 920 with the curved edge 915 (both shown in outline) as it pivots on hinge 345 will remove much of the food product from space Y into space X. Secondary opening piece 920 acts as a small bulldozer (shoveling means). This process leaves smaller amounts of food products in space Y. Space Y is the compartment wherein the food product is readily available. Likewise excess food is trapped in volume X so that snack pieces cannot spill out of bowl.

Figure 14:
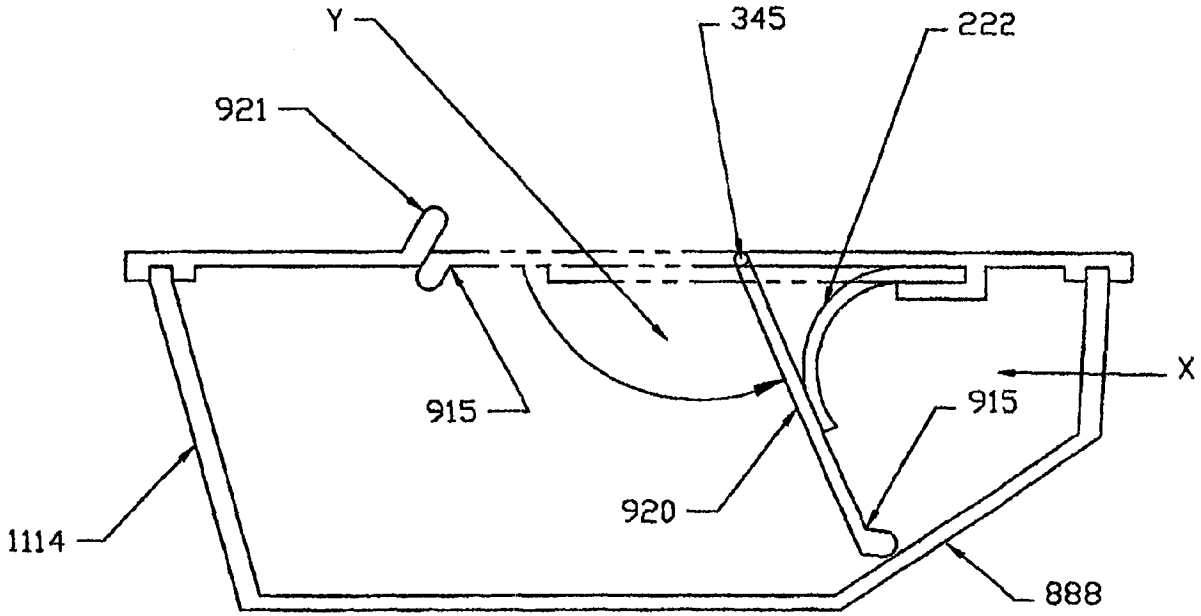
FIG. 14 shows a section of an alternative container for the food snack.

FIG. 14 shows a section of an alternative container for the food snack 1114. Secondary opening piece 920 has a curved down front edge 915. This is complemented by turned up front rim 921 of secondary opening 236. Arrow BN shows that opening piece 920 with the curved edge 915 will remove much of the food product from space Y into space X. Secondary opening piece 920 acts as a small bulldozer. This process leaves smaller amounts of food products in space Y. Space Y is the compartment wherein the food product is readily available. Container box section 1114 has a beveled section 888 in space X. Beveled bottom section 888 has the advantage in that food moved by secondary opening piece 920 will be crushed less and is redirected by beveled surface to prevent food from blocking secondary opening piece movement as those food pieces are moved into space X in which it will be temporarily stored. While the preferred embodiment of secondary opening piece 920 would have both curved down leading edges and side edges the invention would be useful if only the leading edge of the opening piece shown as 915 were curved down and the side edges not also turned down.

Figure 15:
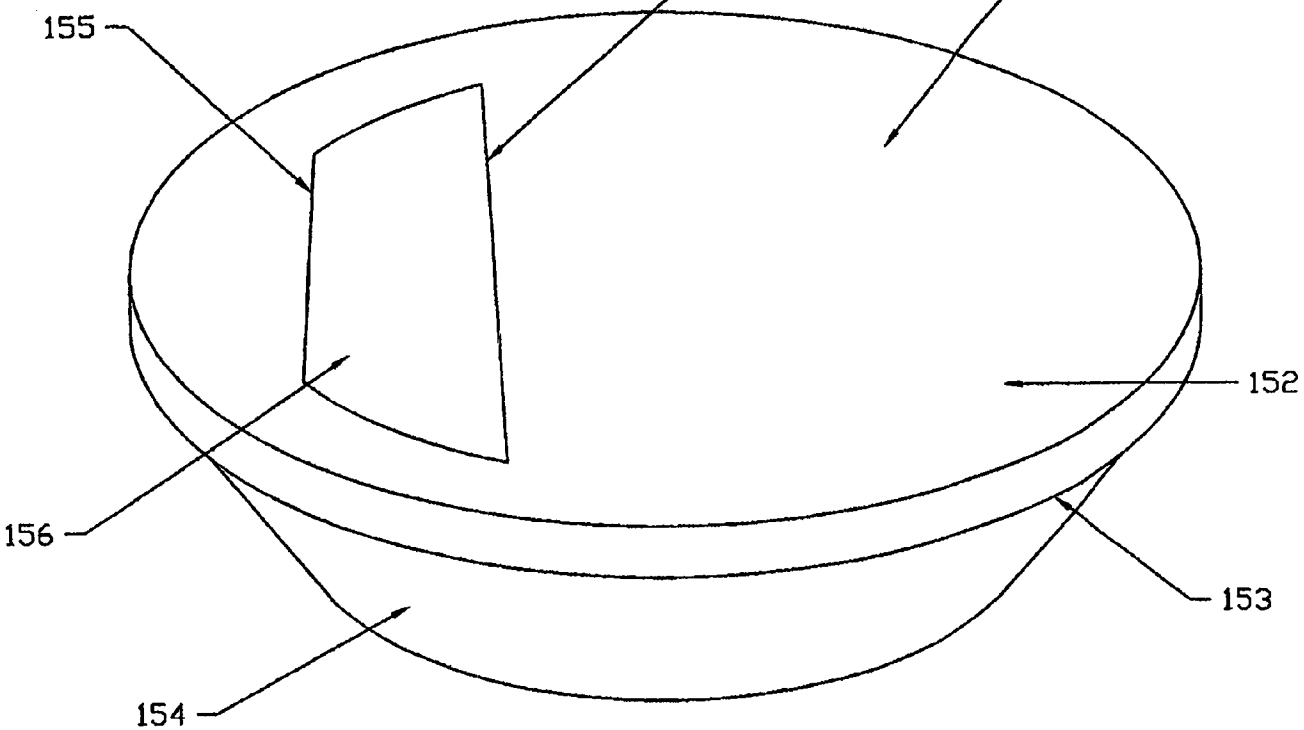
FIG. 15 shows a round bowl shaped container for the food snack container.

FIG. 15 shows that lid 151 is affixed by threaded rim 153 to bowl shaped container 154. Front edge 155 of secondary opening piece 156 is shorter than hinge length 157.

Figure 16:
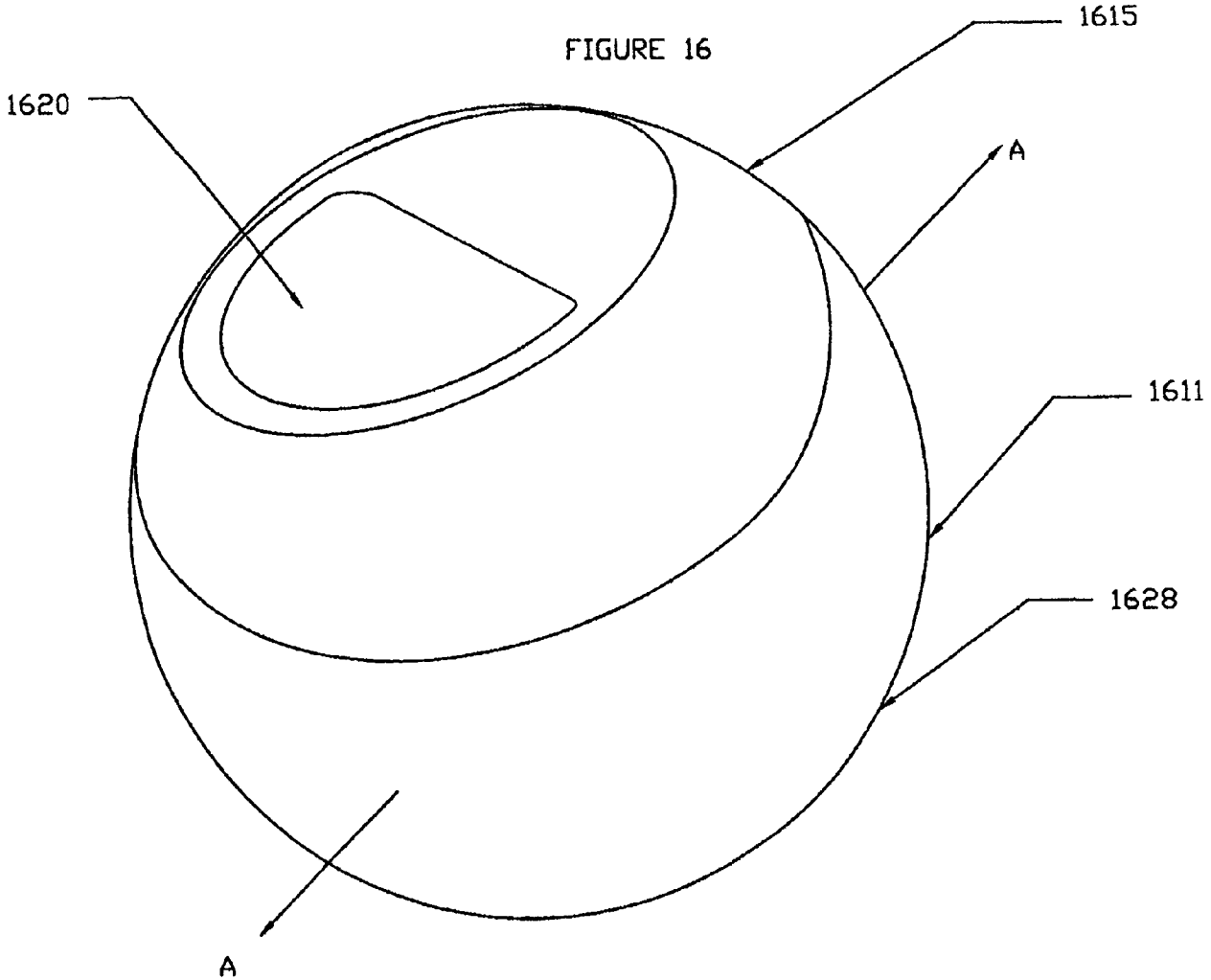
FIG. 16 shows another embodiment of the spill proof snack bowl.

FIG. 16 shows another embodiment of the spill proof snack bowl 1611. Bowl 1611 comprises a spherical shaped storage section 1628, a removable top first lid 1615, and generally half moon shaped secondary opening piece 1620.

Figure 17:
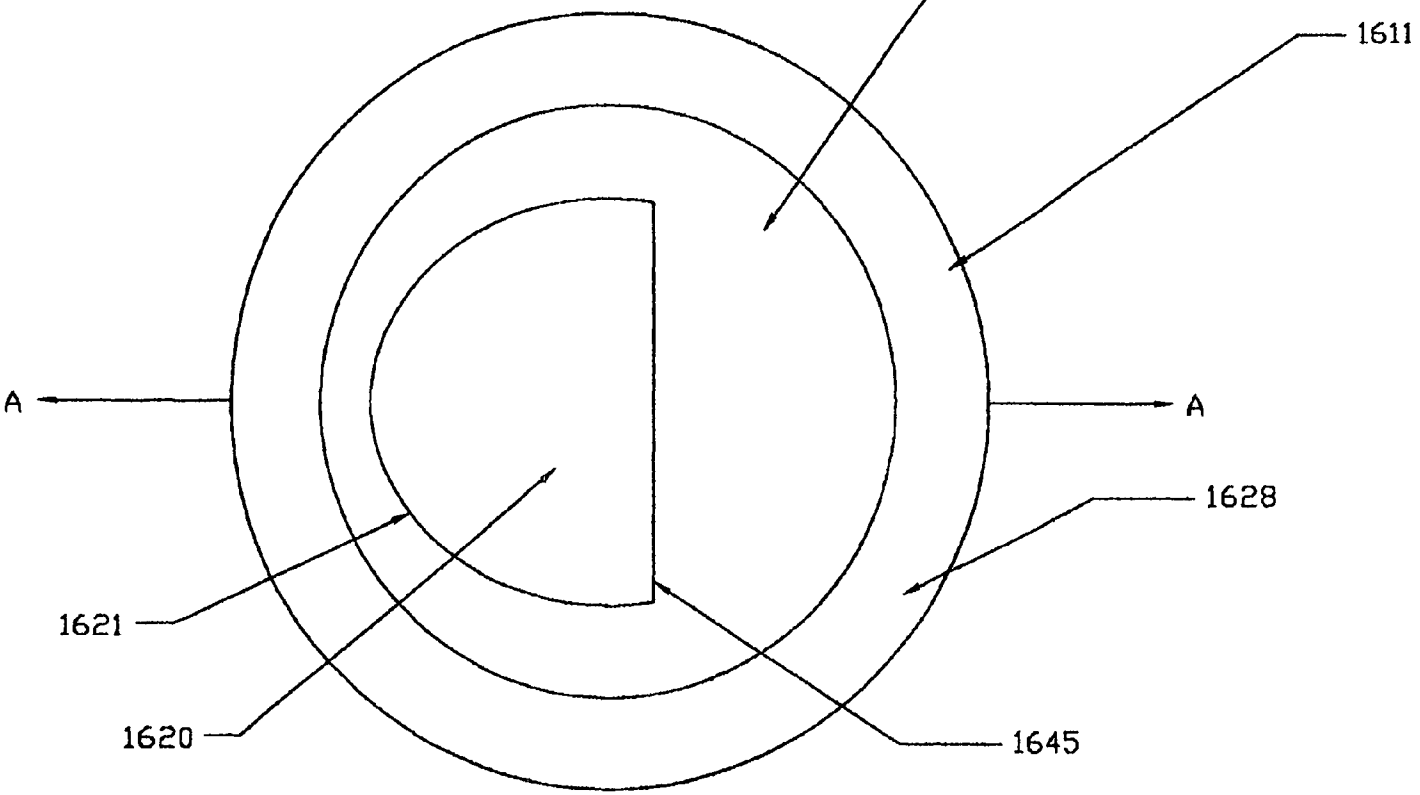
FIG. 17 shows a top view of spill proof snack bowl.

FIG. 17 shows a top view of spill proof snack bowl 1611. Spherical bowl section 1628 is shown to be of greater diameter than removable top first lid 1615 with secondary opening piece 1620. Secondary opening piece 1620 is a generally half moon shaped piece. It has a hinge lengthen 1645 and a semi-circular or semi-elliptical edge 1621.

Figure 18:
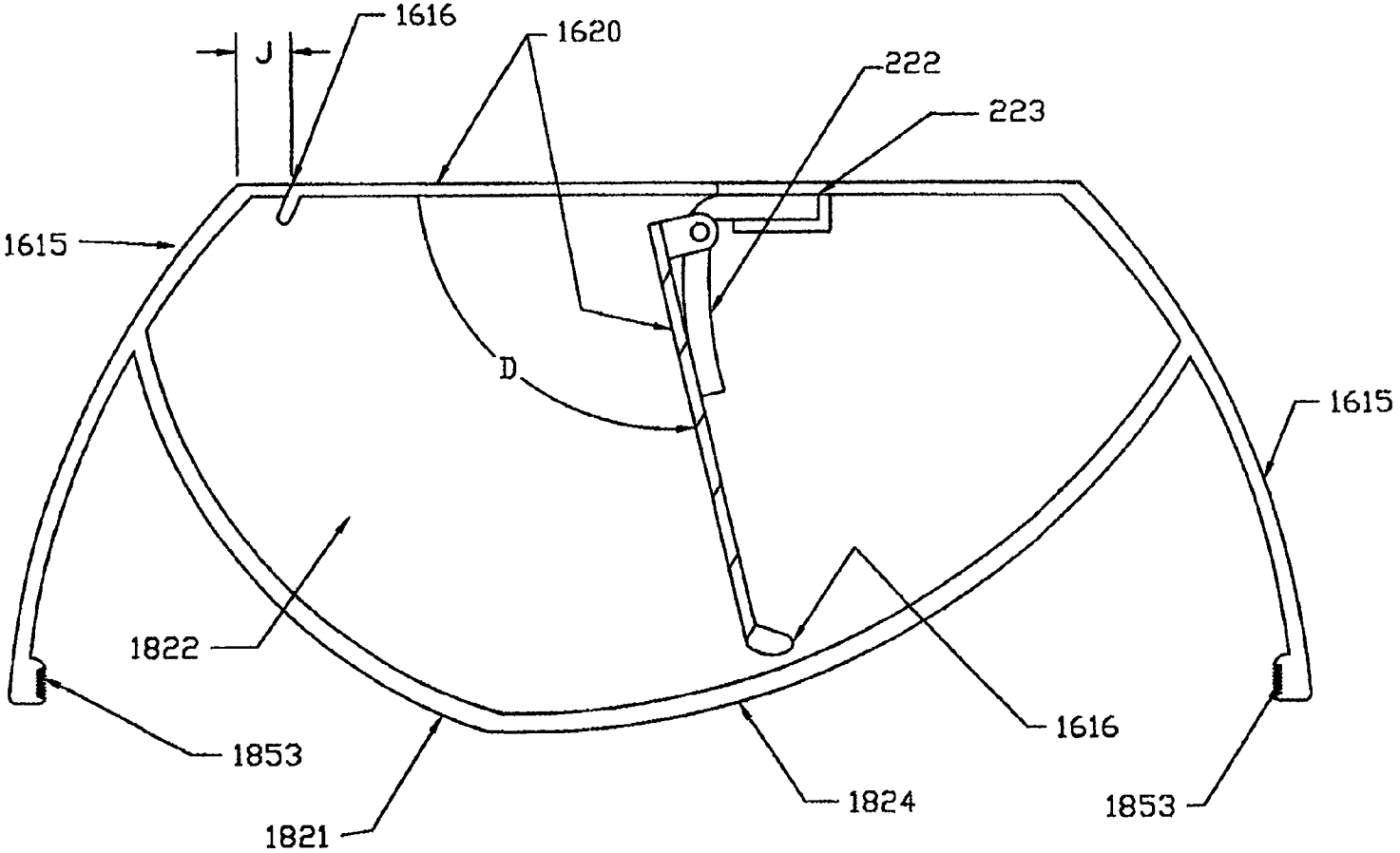
FIG. 18 shows cut A-A from FIG. 17.

FIG. 18 shows cut A-A from FIG. 17, which cut is of removable first top lid 1615. Secondary opening piece 1620 with turned down front edge 1616 has an opening angle D. Flat (leaf) spring 222 is affixed into slot 223 to provide a means to urge the secondary opening piece 1620 to close. Top first lid floor 1821 provides a forward volume 1822. The forward volume 1822 is analogous to space Y of the prior figures. Support section 1824 is analogous to side walls in previous descriptions. Threaded rim 1853 shows an attachment means to affix top first lid 1615 to spherical shaped box section 1628. Length J should be between about ⅛ and ¾ inch.

Figure 19:
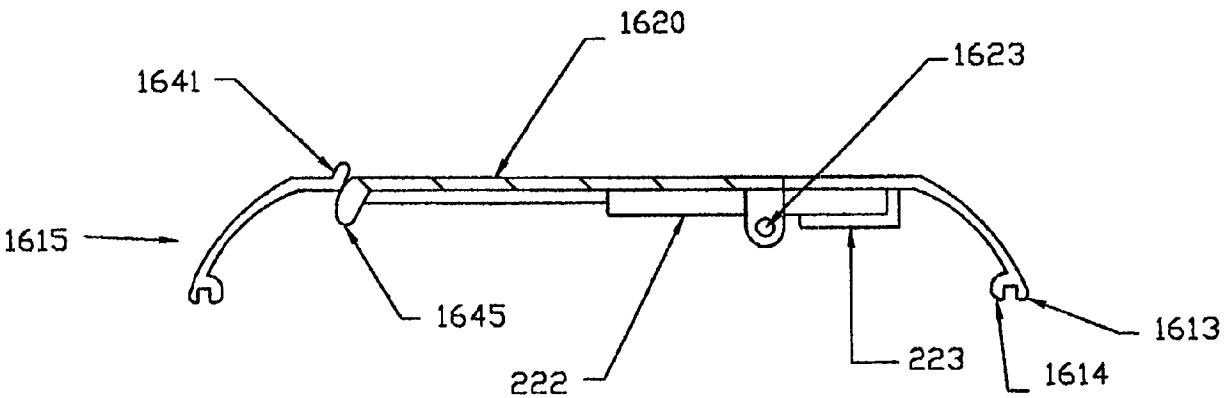
FIG. 19 shows the cut A-A from FIG. 17, which is cut of removable first top lid 1615.
Figure 20:
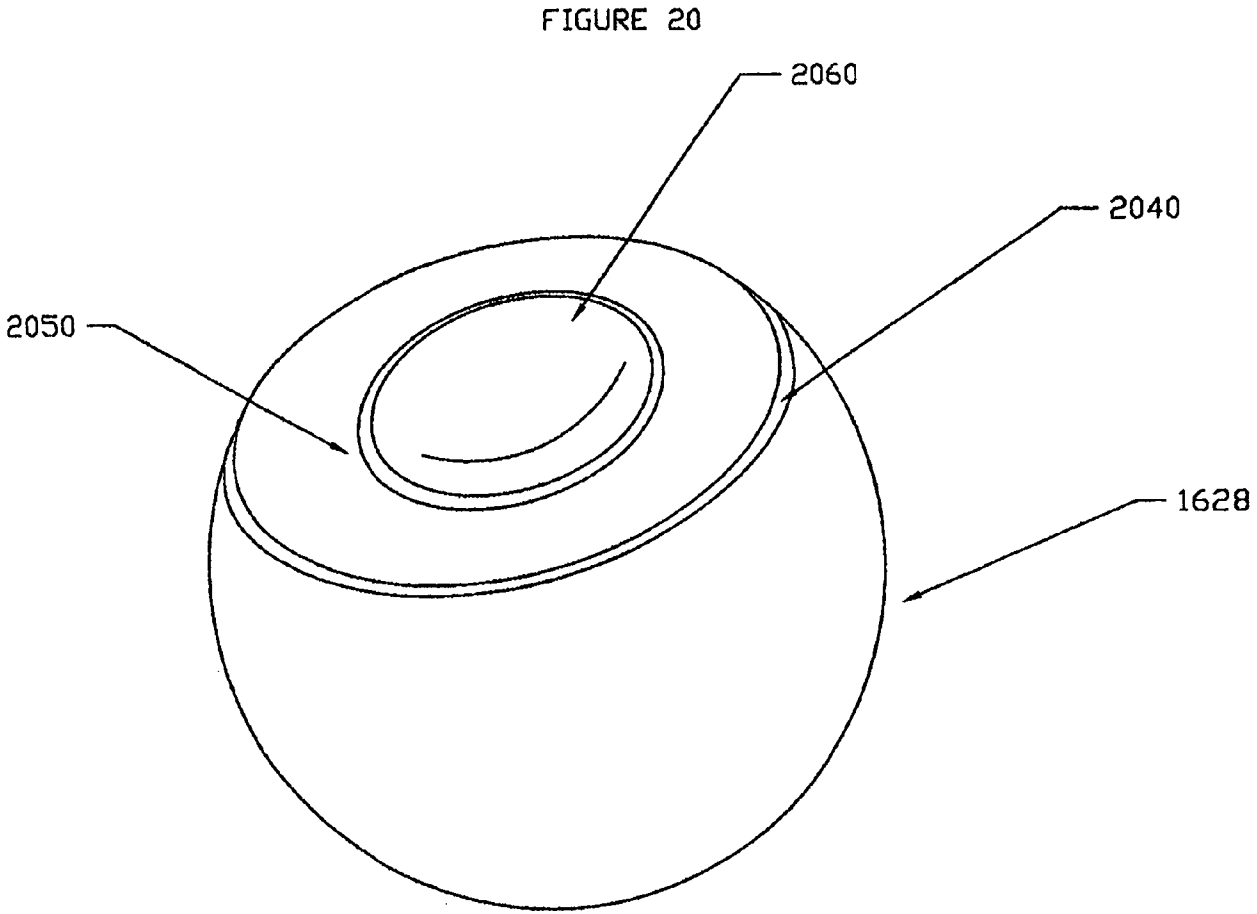
FIG. 20 shows the spherical shaped section.

FIG. 19 shows the cut A-A from FIG. 17, which is cut of removable first top lid 1615. Turned up rim of 1641 is complemented by the turned down edge 1645 of secondary opening piece 1620. Turned up rim 1641 and turned down edge 1645 prevent small fingers and hands from being caught in secondary opening. Flat spring 222 is affixed into slot 223 to provide a means to urge the secondary opening piece 1620 to close. Hinge 1623 allows secondary opening piece 1620 to be deflected downward. Friction fitting lid 1615 with a secondary opening piece 1620 is affixed to spherical bowl (box) section 1628. with outer lip ridge 1613 and inner lip ridge 1614. FIG. 20 shows the spherical shaped section 1628 with threads 2040. A continuous surface 2050 creates an enclosed top for spherical shaped section 1628. Continuous surface 2050 would be the bottom when removable first top lid 1615 is placed on spherical shaped section 1628. A rounded beveled depression 2060 will allow a semi-circular or semi-elliptical edge 1621 of secondary opening piece 1620 to sweep product from accessible space Y to inaccessible space X.

Figure 21:
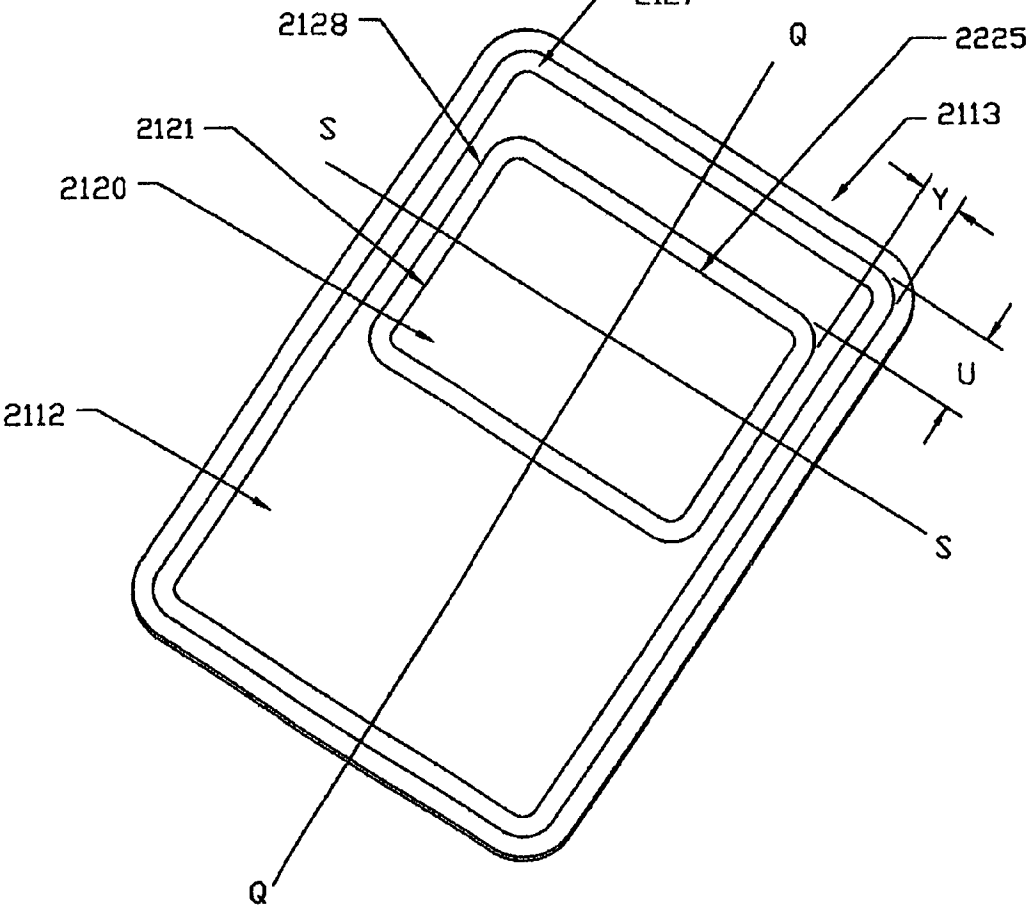
FIG. 21 shows an alternative friction fitting lid for the container for snacks.

FIG. 21 shows an alternative friction fitting (cover) lid 2112 for the container for snacks showing secondary opening piece 2120. Friction fitting lid 2112 is designed for ease of manufacturing. Outer lip ridge 2113 will affix lid 2112 to a container for snacks. The distance U between the leading edge 2225 of secondary opening piece 2120 and the inner lip ridge 2114 should be between about ⅛ and ¾ inch. An outer seal furrow 2127 helps define inner lip ridge 2114. Inner seal furrow 2128 partly defines curved ridge 2121.

Figure 22:
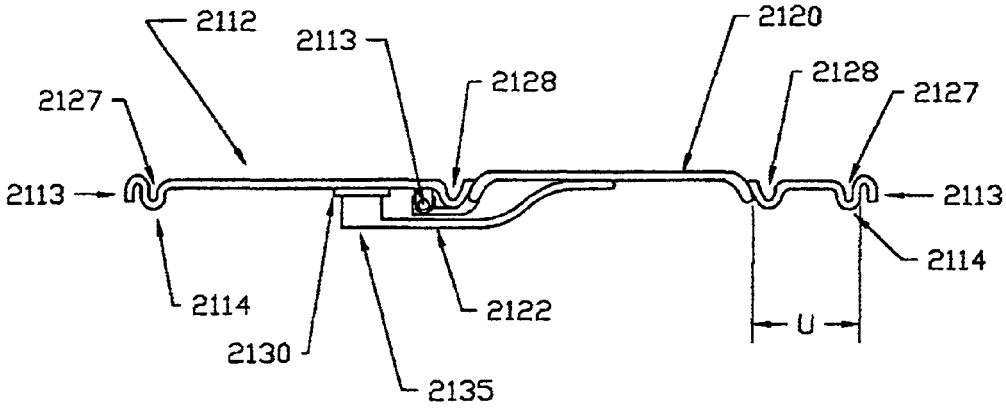
FIG. 22 shows cut Q-Q of friction fitting lid of FIG. 21.

FIG. 22 shows cut Q-Q of friction fitting (cover) lid 2112 of FIG. 21 for the container for snacks showing secondary opening piece 2120. Outer lip ridge 2113 cooperating with inner lip ridge 2114 will affix lid 2112 to a container for snacks. The distance U should be between about ⅛ and ¾ inch. Elastomeric flat spring 2122 is positioned and guided with locator bead 2130 which is manufactured as part of the molding of friction fitting lid 2112. Elastomeric flat spring 2122 with spacer extension 2135 is affixed to locator bead 2130 by various conventional means such as adhesives, pressed, molded, riveted, or other affixing means know to the art.

Figure 23:
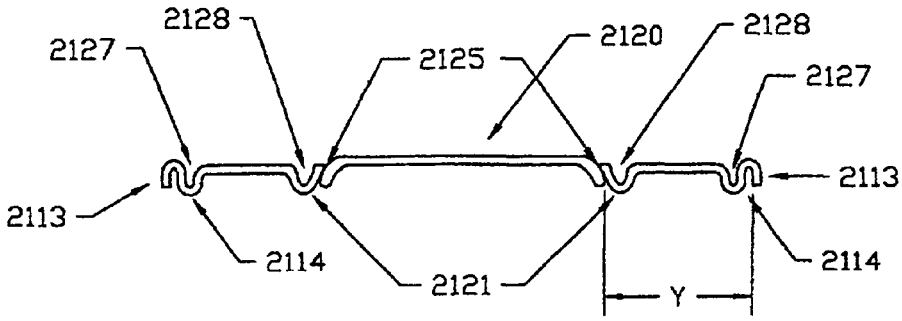
FIG. 23 shows cut S-S of FIG. 21.
Figure 24:
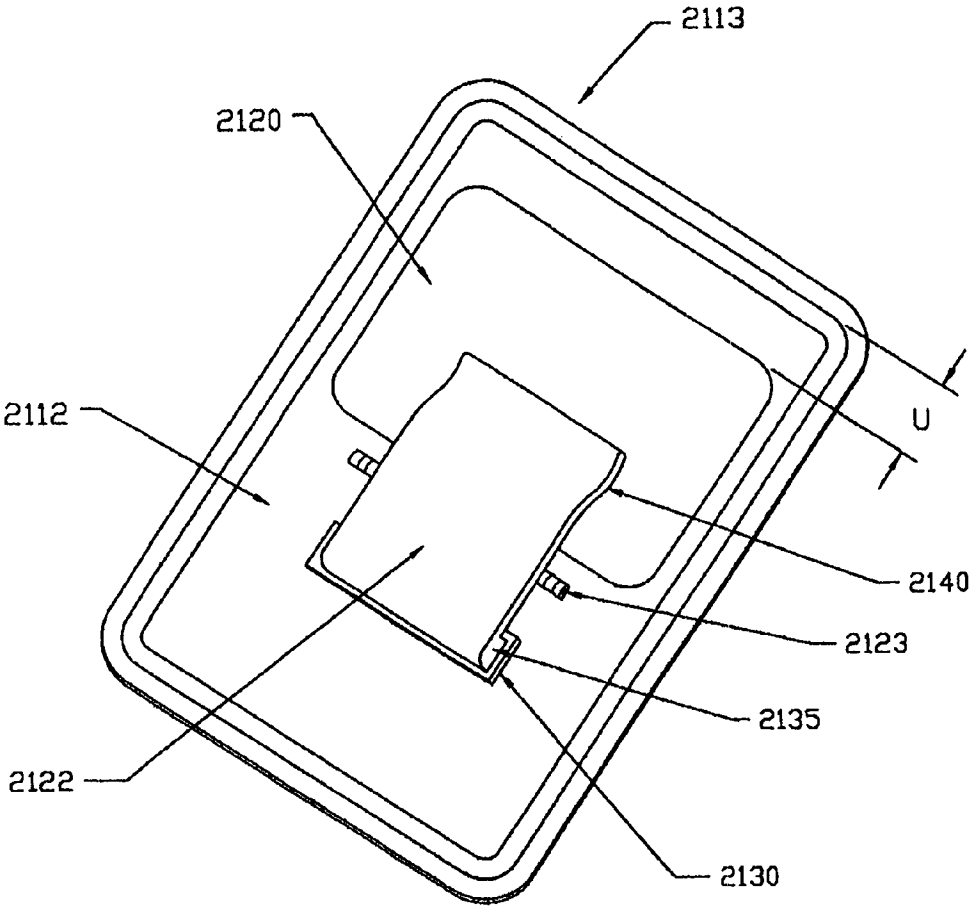
FIG. 24 shows an underside view of alternative friction fitting lid for the container for snacks showing secondary opening piece.

FIG. 23 shows cut S-S of FIG. 21. Friction fitting lid 2112 for the container for snacks showing secondary opening piece 2120 with side edges 2125. Outer lip ridge 2113 cooperating with inner lip ridge 2114 will affix lid 2112 to a container for snacks. The distance Y should be between about ⅛ and ¾ inch. An outer seal furrow 2127 helps define inner lid ridge 2114. Inner seal furrow 2128 partly defines curved rim 2121. FIG. 24 shows an underside view of alternative friction fitting lid 2112 for the container for snacks showing secondary opening piece 2120. Friction fitting lid 2112 is designed for ease of manufacturing. Outer lip ridge 2113 will affix lid 2112 to a container for snacks. Elastomeric flat spring 2122 with spacer extension 2135 is affixed to locator bead 2130 by various conventional means such as adhesives, pressed, molded, riveted, or other affixing means know to the art. An optional bend 2140 in elastomeric flat spring 2122 improves the urging of elastomeric flat spring 2122 to close secondary opening piece 2120. Elastomeric flat spring 2122 may be manufactured of thermoplastic rubber such as TPR sold for example under the name Santoprene™ or a urethane rubber. Hinge 2123 may be manufactured to flex to aid the placement of secondary opening piece 2120.

Figure 25:
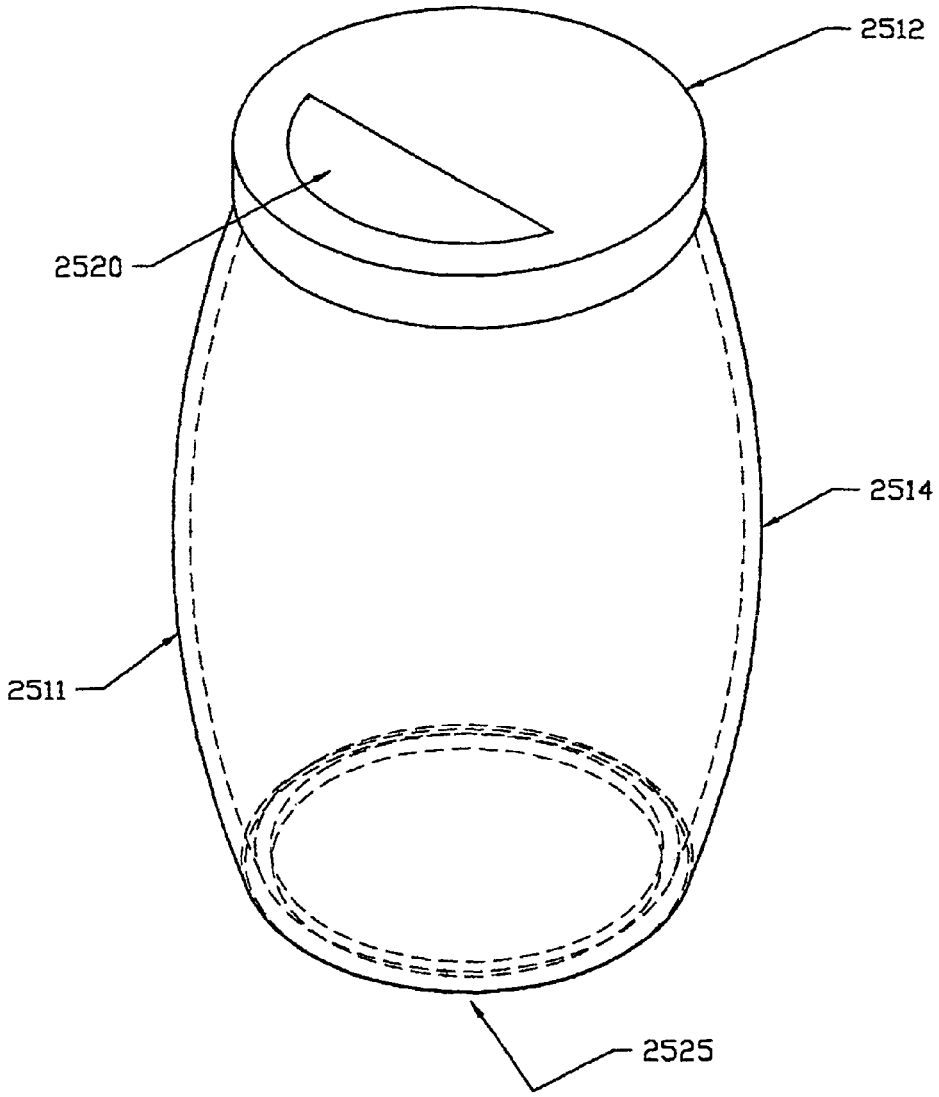
FIG. 25 shows the placement of the lid for container affixed to a tumbler shaped container that can be used for beverages.

FIG. 25 shows the placement of the lid for container affixes to a tumbler shaped container 2511 that can be used for beverages. Tumbler shaped container 2511 has a tumbler top 2512 with generally half moon shaped secondary opening piece 2520. Tumbler top 2512 with secondary opening piece 2520 operates in essentially the same manner as other described tops or lids of the present invention. Tumbler shaped section 2511 has a wall 2514 and a bottom 2525.

Figure 26:
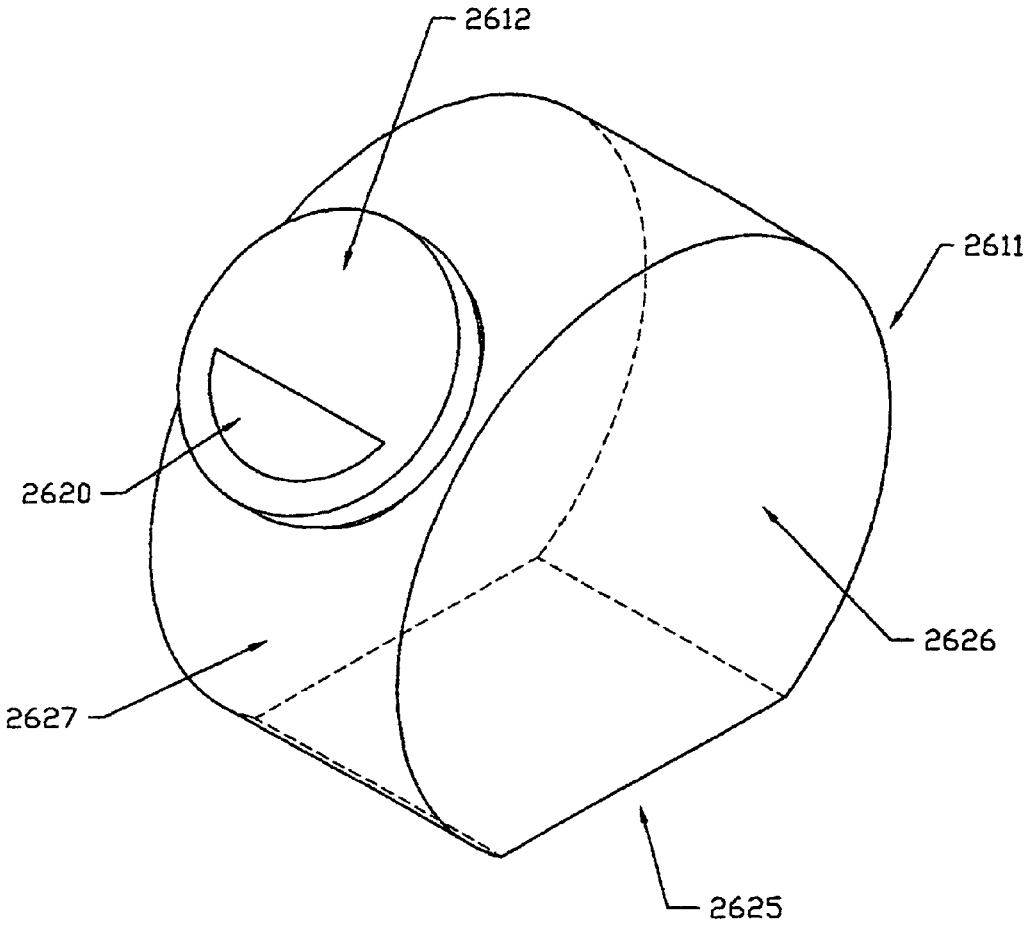
FIG. 26 shows the placement of the lid for container affixed to a truncated puck shaped container that can be used for snacks.

FIG. 26 shows the placement of the lid for container affixes to a truncated puck shaped container 2611 that can be used for food. Truncated puck shaped container 2611 has a top 2612 with a secondary opening piece 2620. Truncated puck shaped container top 2612 with secondary opening piece 2620 operates in essentially the same manner as other described tops or lids of the present invention. Truncated puck shaped section 2611 has two sided flat walls 2626, a cylindrically shaped wall 2627, and a bottom 2625. Note, top 2612 is at an acute angle relative to bottom 2625.

Figure 27:
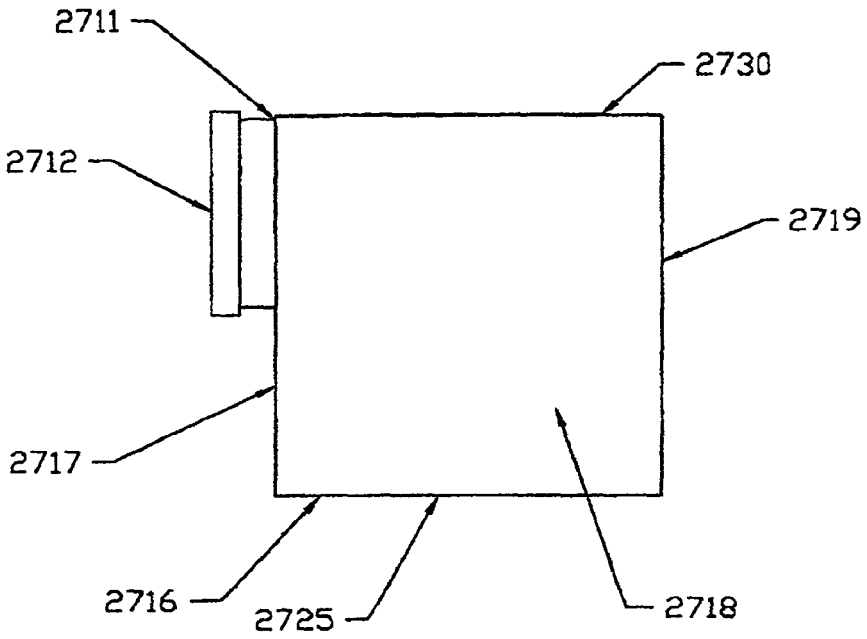
FIG. 27 shows a side view the placement of the lid for container affixed to a side of box shaped container that may be used for larger solid pieces.

FIG. 27 shows a side view with the lid for container affixed to a side of box shaped container 2711 that may be used for larger solid pieces. Box shaped container 2711 has a side 2717 with a container lid 2712 which container lid operates in essentially the same tops or lids of the present invention.

Figure 28:
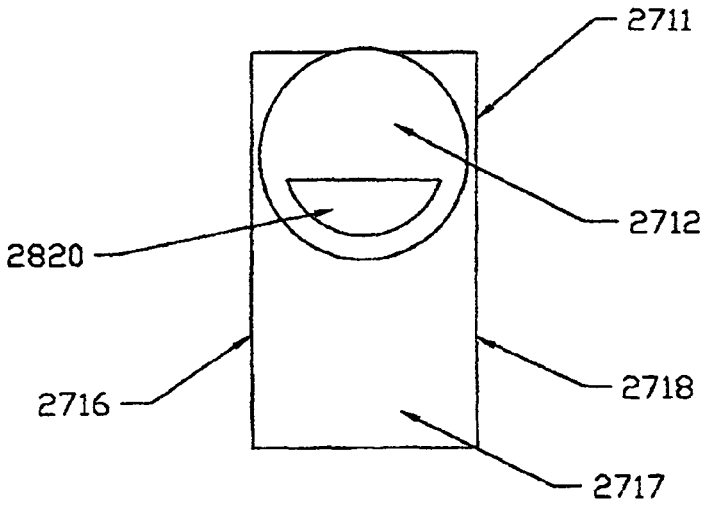
FIG. 28 shows a second side view of box shaped container.

FIG. 28 shows a side view of box shaped container 2711. Container lid 2712 is affixed to a side of box shaped container 2711 that may be used for larger solid pieces. Box shaped container 2711 has a side 2717 with a container lid 2712 and a secondary opening piece 2820. Container lid 2712 operates in essentially the same manner as other described manner as other described tops or lids of the present invention. Box shaped container section 2711 has six flat walls 2716, 2717, 2718, 2719, a top 2730, and a bottom 2725. Note, container lid 2712 is at a 90° angle relative to bottom 2725.

Figure 29:
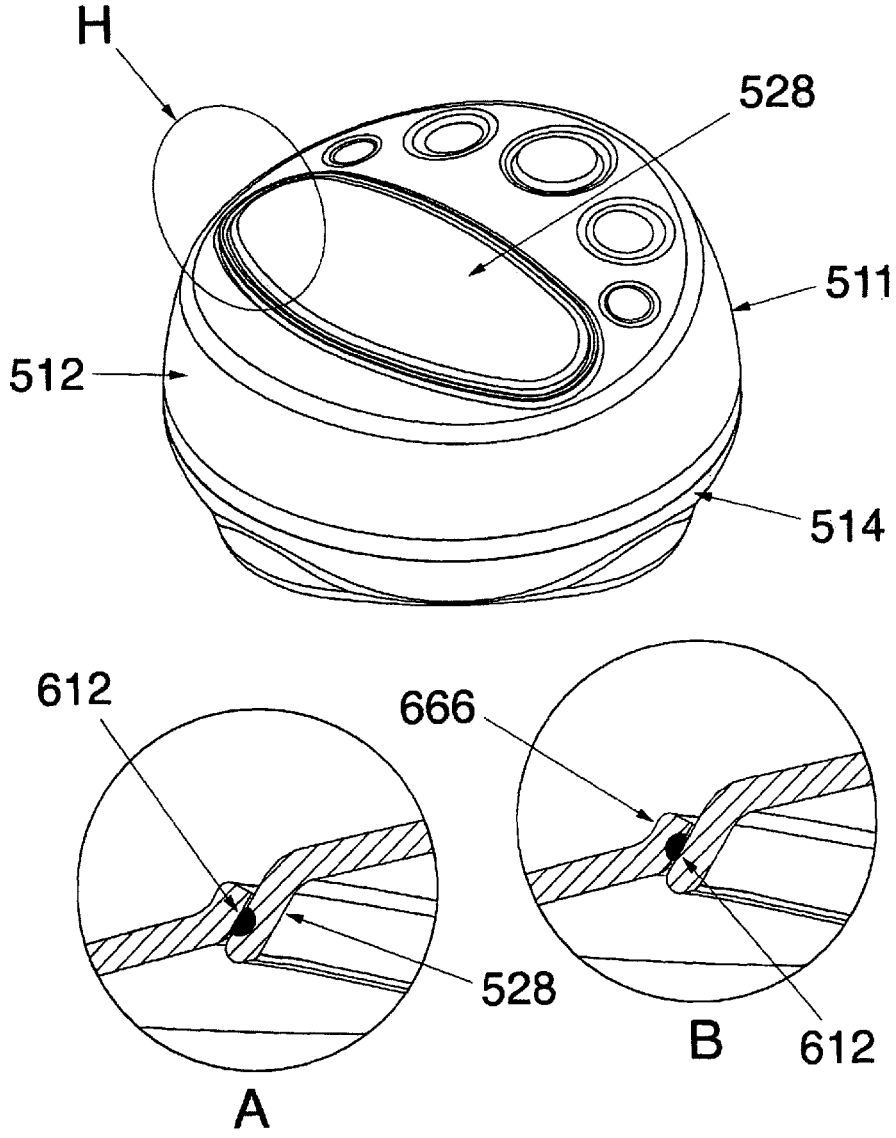
FIG. 29 shows a perspective of a second embodiment of spill proof snack bowl 511 with illustrations of elastomeric seal.
Figure 30:
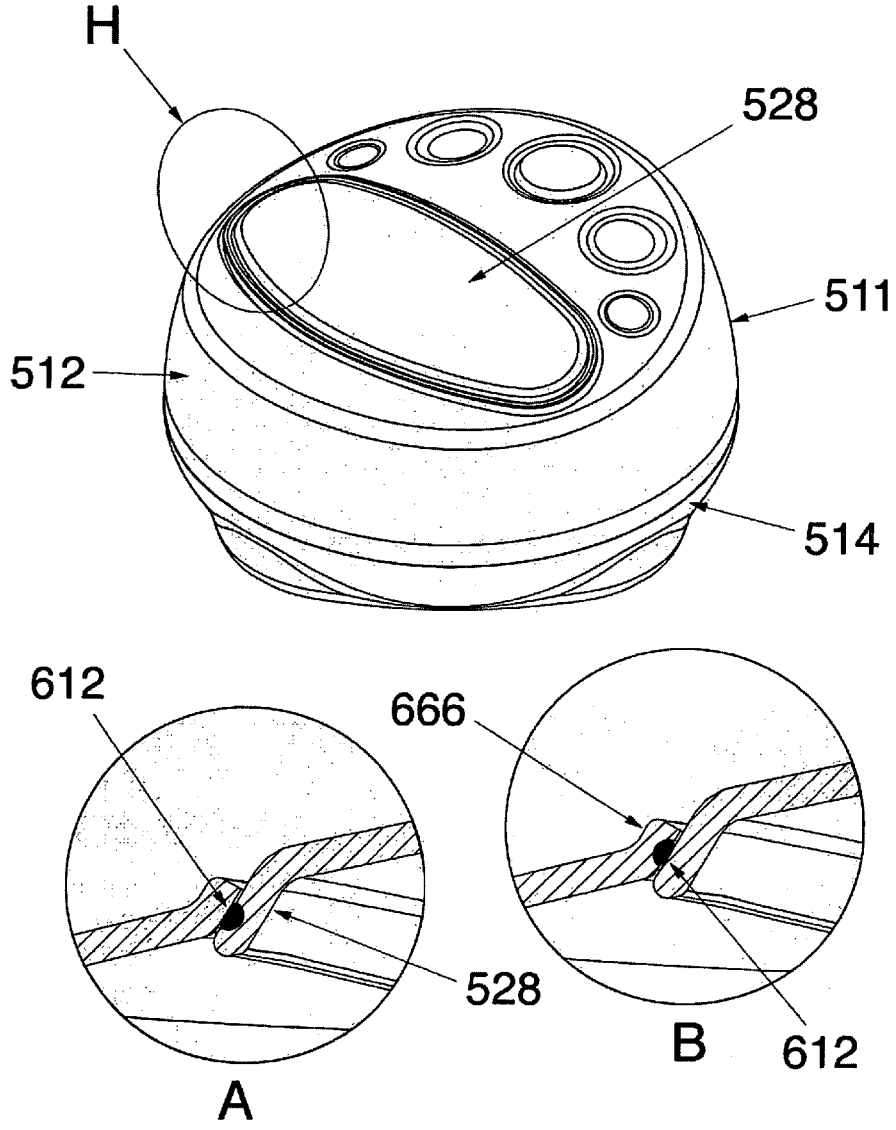
FIG. 30 shows a perspective of a second embodiment of spill proof snack bowl 511 with elastomeric seals.

FIG. 29 shows a perspective of a second embodiment of spill proof snack bowl 511. Snack bowl 511 has a friction fitting lid 512. Friction fitting lid 512 is affixed to generally round container 514. Friction fitting lid 512 is has a generally half-moon shaped secondary opening piece 528. Circle cut H is shown in details 29A and 29 B. Detail A shows that the electromeric seal shown as 612 if FIG. 6 can be on secondary opening piece 528. Detail B shows that the electromeric seal shown as 612 in FIG. 6 can be on turned up edge 666 of secondary opening piece 528.

While the above figures describe a removable lid with either a friction fitting lid or a threaded rim lid, there are other attachment means to affix a lid to a bowl or a container as a visit to any large household goods store will show.

We claim:

1. A spill proof snack bowl comprising:

a box section;

said box section has a bottom;

a continuous wall to create a depth and an open top;

a removable lid;

a secondary opening is within said removable lid;

a secondary opening piece;

said secondary opening piece is attached to said removable lid with a hinge;

said secondary opening piece closes said secondary opening by a biasing means;

said secondary opening piece has a hinged length and a perpendicular width;

said perpendicular width has a ratio with said box depth such that when said removable lid is affixed to said box section and when said secondary opening piece is opened the opening angle exceeds 90° degrees;

wherein said depth is not greater than ½ inch more than that of said width of said secondary opening piece when said secondary opening piece is opened at a 90° angle with said bottom;

wherein said secondary opening has upwardly curved side rim and an upwardly curved front rim;

wherein said secondary opening piece has a downwardly curved front edge and downwardly curved side edges;

wherein a first distance between front wall and said secondary opening piece edge is between about ⅛ and ¾ inch;

and second distances between said secondary opening piece when perpendicular with said continuous wall are between about ⅛ and ¾ inch.

2. A spill proof snack bowl as in claim 1 wherein said biasing means is a flat spring.

3. A spill proof snack bowl as in claim 1 wherein said hinge is a living hinge.

4. A spill proof snack bowl as in claim 1 wherein said box section is generally square or rectangular.

5. A spill proof snack bowl as in claim 1 wherein said box section is generally round, oval, spherical, or bowl shaped container.

6. A spill proof snack bowl as in claim 1 wherein said removable lid means is a friction fitting lid or a threaded rim lid.

7. A spill proof snack bowl as in claim 1 wherein said secondary opening has an elastomeric seal.

8. A spill proof snack container as in claim 1 wherein said biasing means is a leaf spring;

said leaf spring is affixed to the secondary opening pieces as pressed, molded, riveted, or other affixing means known to the art.

* * * * *